US006397588B1

(12) United States Patent
Brück et al.

(10) Patent No.: US 6,397,588 B1
(45) Date of Patent: Jun. 4, 2002

(54) CATALYTIC CONVERTER FOR CLEANING EXHAUST GAS AND EXHAUST GAS PURIFICATION ASSEMBLY WITH A CATALYTIC CONVERTER

(75) Inventors: Rolf Brück, Bergisch Gladbach; Jörg-Roman Konieczny, Siegburg, both of (DE)

(73) Assignee: Emitec Gesellschaft fur Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/583,790

(22) Filed: May 31, 2000

(51) Int. Cl.[7] ..... F01N 3/10
(52) U.S. Cl. ..... 60/299; 60/280; 422/177
(58) Field of Search ..... 60/274, 280, 299; 422/177

(56) References Cited

U.S. PATENT DOCUMENTS

| | | | | | |
|---|---|---|---|---|---|
| 3,513,929 | A | * | 5/1970 | Kim | 60/280 |
| 3,775,971 | A | * | 12/1973 | Gadefelt | 60/280 |
| 3,798,906 | A | * | 3/1974 | Woollenweber | 60/280 |
| 3,951,626 | A | * | 4/1976 | Carey | 60/280 |
| 4,553,387 | A | * | 11/1985 | Mayer | 60/280 |
| 4,709,548 | A | * | 12/1987 | Conrad et al. | 60/280 |
| 4,910,959 | A | * | 3/1990 | Dones | 60/280 |
| 5,142,864 | A | * | 9/1992 | Dunne | 60/280 |
| 5,709,081 | A | * | 1/1998 | Bruestle | 60/280 |
| 5,849,250 | A | * | 12/1998 | Timko | 422/177 |
| 5,849,251 | A | * | 12/1998 | Timko | 422/177 |
| 6,006,516 | A | * | 12/1999 | Voss et al. | 60/299 |
| 6,089,211 | A | * | 7/2000 | Wenger | 60/280 |

FOREIGN PATENT DOCUMENTS

| | | |
|---|---|---|
| DE | 3518756 | * 11/1986 |
| JP | 52-44324 | * 7/1977 |
| JP | 60-178921 | * 9/1985 |
| JP | 60-261930 | * 12/1985 |
| JP | 63-309725 | * 12/1988 |
| WO | WO 92/20911 | * 11/1992 |

* cited by examiner

*Primary Examiner*—Thomas Denion
*Assistant Examiner*—Tu M. Nguyen
(74) *Attorney, Agent, or Firm*—Laurence A. Greenberg; Werner H. Stemer; Gregory L. Mayback

(57) ABSTRACT

A catalytic converter for cleaning the exhaust gas of an internal combustion engine with a supercharger. The catalytic converter has a catalyst carrier body and is adapted to being fitted into a connecting joint in an exhaust pipe upstream of supercharger in a direction of exhaust gas flow. A retaining element fastens the catalyst carrier body in the connecting joint.

13 Claims, 1 Drawing Sheet

CATALYTIC CONVERTER FOR CLEANING EXHAUST GAS AND EXHAUST GAS PURIFICATION ASSEMBLY WITH A CATALYTIC CONVERTER

BACKGROUND OF THE INVENTION

Field of the Invention

The invention relates to a catalytic converter for purifying the exhaust gas of a combustion engine with a supercharger based on the exhaust turbocharger principle and to an exhaust gas purification system with a catalytic converter for such an engine.

In the case of catalytic converters of this type, it is desirable to arrange a catalyst carrier body of the converter as close as possible to the exhaust outlet of the engine, in order to ensure an adequate light-off temperature, which is required for the catalytic conversion and treatment of the exhaust gas, in every operating state of the engine. Catalytic converters for engines with superchargers, hereafter also referred to as an exhaust turbocharger, have the problem that the temperature of the exhaust gas is additionally reduced by the energy removal for compressing combustion air in comparison with engines without an exhaust turbocharger. Specifically in the case of diesel engines, in which the temperatures of the exhaust gas are in any case relatively low (exhaust-gas temperatures when idling approximately 100–200° C., under full load approximately 550–750° C. at the outlet), this leads to a deterioration in the overall degree of conversion of the exhaust gas purification system and exhaust gas can increasingly be emitted in an untreated form. In other words, increased pollutant emission can occur with these engines.

Recently, the statutory regulations concerning exhaust emission limit values (for example the EU exhaust regulations stages 2 and 3) have become increasingly stringent, so that there is a considerable and increasing need for a further reduction in the pollutant emissions of engines. Extensive efforts have recently been undertaken in this respect to optimize further existing, conventional catalyst systems for engines, in order to achieve effective emission control in all operating states and with every type of engine, including in the critical cold-starting phase of the engine.

By way of example, international PCT publication WO 99/11911 describes a catalyst carrier assembly which has at least one catalyst carrier body which can be arranged with a flange-like fastening section between a cylinder head and an exhaust manifold. A disadvantage of that catalyst support assembly, which is also referred to as a cylinder head catalyst, is that the catalyst carrier bodies must be adapted to different cylinder head dimensions and forms of manifold, respectively corresponding to the specific conditions. This makes cost-effective production virtually impossible. What is more, a separate catalyst carrier body is required for each cylinder. With these cylinder head catalysts, difficulties also arise because of the at times very high exhaust rates at an individual cylinder head outlet.

SUMMARY OF THE INVENTION

It is accordingly an object of the invention to provide a catalytic converter for combustion engines with an exhaust turbocharger, which overcomes the above-mentioned disadvantages of the heretofore-known devices and methods of this general type and which is of a simple design, permits efficient conversion even at low exhaust-gas temperatures, and can be produced in a simple way.

With the foregoing and other objects in view there is provided, in accordance with the invention, a catalytic converter for cleaning exhaust gas of an internal combustion engine with an exhaust turbocharger. The internal combustion engine has an exhaust pipe with a connecting joint and a supercharger for compressing a combustion air on the principle of an exhaust turbocharger. The catalytic converter comprises:

- a catalyst carrier body formed with a multiplicity of flow channels;
- a tubular jacket encasing the catalyst carrier body;
- the catalyst carrier body being adapted to being fitted into the connecting joint in the exhaust pipe ahead of the supercharger in a flow direction of the exhaust gas; and
- a retaining element for fastening the catalyst carrier body in the connecting joint.

In other words, the catalytic converter according to the invention has a catalyst carrier body which is adapted for being fitted into a connecting joint of the exhaust pipe ahead of the supercharger, i.e. upstream of the exhaust turbocharger in the exhaust gas flow direction. As a result, it is possible with the catalytic converter according to the invention even to treat exhaust gases which, ahead of the exhaust turbocharger, are still at a temperature level above the catalytic reaction temperature but, after the exhaust turbocharger, would be at too low a temperature to allow them to be catalytically treated. This is so because, with the invention, at least part of the exhaust gas is treated ahead of the exhaust turbocharger. With the catalytic converter according to the invention, it is consequently possible to further reduce the fraction of untreated exhaust gas, which in the case of engines with an exhaust turbocharger leads to poorer emission values.

Furthermore, the catalytic converter according to the invention can be produced equally well for a large number of engine types, without regard to special designs of cylinder heads of the combustion engine or geometries of the exhaust manifold. It can be fitted into the corresponding section of the exhaust pipe. This is achieved in particular by the catalyst carrier body being adapted for being fitted into a connecting joint of the exhaust pipe that lies between the combustion engine and the supercharger, i.e. which lies upstream of the exhaust turbocharger in the direction of flow of the exhaust gas.

The operating mode of the exhaust turbocharger arranged downstream in the direction of flow is not hindered at all, or scarcely at all, by the catalyst carrier body, since the latter is adapted for being fitted there. The adaptation of the catalyst carrier body takes place for example by adapting its form, its length, its number of flow channels per unit area of the cross section or other catalytic converter parameters.

Also provided is a retaining element for fastening the catalyst carrier body in the connecting joint. The advantage of such a retaining element is that an additional housing for the catalyst carrier body is not necessary. The retaining element allows fitting inside the exhaust pipe. The catalytic converter can consequently be fitted at this in any case already spatially restricted location between the combustion engine and the exhaust turbocharger, indeed with very simple means.

In accordance with an added feature of the invention, the retaining element is a collar-type bead formed on the tubular jacket or a collar formed on an end section of the tubular jacket.

The bead on the jacket allows the catalytic converter to be inserted into any desired tail-pipe end section and fastened within the exhaust pipe like a pocket. The collar-like bead is advantageous in particular as a retaining element if the catalytic converter is fastened at a flange-like connecting joint of two tail-pipe sections. The two tail-pipe sections may in such a case be connected by means of conventional pipe clips, the bead being clamped in between the two flange-like end sections of the tail-pipe ends.

The crimped collar on the tubular jacket allows the catalytic converter to be inserted into the exhaust pipe like a pocket, but in this case the catalyst carrier body and/or the tubular jacket merely protrude(s) in one direction into the exhaust pipe. In this way, the catalytic converter can also be fitted into a connecting joint of the exhaust pipe which has devices in the direction of flow preventing elements from being arranged within the exhaust pipe in this direction. For example, this may be the case if a relatively long catalytic converter according to the invention is to be arranged in the proximity of the exhaust turbocharger.

In accordance with an additional feature of the invention, the tubular jacket of the catalyst carrier body is an intermediate section of the exhaust pipe and the tubular jacket has a fastening element at each of its ends, for connecting to adjacent sections of the exhaust pipe. In this way, the catalytic converter can be designed as a subsection of the exhaust pipe in that its tubular jacket has the same outside diameter as the adjacent tail-pipe sections. This makes it possible to make the cross-sectional area of the catalyst carrier body almost as large as the cross-sectional area of the space inside the exhaust pipe. The catalyst carrier body can in this case be shorter in its longitudinal extent, with the same catalyst surface area, than a catalyst carrier body according to one of the previous claims.

In accordance with another feature of the invention, the catalyst carrier body is adapted for being fitted into an exhaust inlet opening of the supercharger. This may be advantageous if, for example, the exhaust inlet opening of the supercharger has the form of a pipe stub into which the catalyst carrier body can be inserted in the manner of a pocket. In this way, the catalytic converter is located inside the exhaust turbocharger housing, as a result of which the adjacent tail-pipe sections can be exchanged as desired, independently of the catalytic converter. The catalyst carrier body can in this case be exchanged by releasing the fastenings at the connecting joint of the exhaust turbocharger, i.e. the catalytic converter also does not require any fastening elements of its own here.

In accordance with a further feature of the invention, the catalyst carrier body is a metallic catalyst carrier body. Metallic catalyst support bodies have the special advantage here of avoiding any risk of damage to the exhaust turbocharger arranged downstream in the direction of flow of the exhaust gas, for example due to crumbling-away parts of a ceramic catalyst carrier body. Since the inside walls of the catalyst carrier body or its exhaust channels running in the direction of flow consist of metal, it is ensured that no solid component parts of the catalytic converter can become detached and get inside the exhaust turbocharger. According to an advantageous refinement in this respect, the catalyst carrier body is a metallic honeycomb body which is produced from wound layers of sheet metal. As a result, the catalyst carrier body or its thin walls of the flow channels form a very low flow resistance for the exhaust gas flowing past. The advantage of this is that the effectiveness or operation of the exhaust turbocharger is not diminished by a possible decrease in the kinetic energy present in the exhaust gas due to the upstream catalytic converter.

In accordance with again a further feature of the invention, the catalyst carrier body can be integrated into the supercharger and forms a unit with the supercharger. As a result, the catalytic converter together with the exhaust turbocharger can be produced as a compact module by a supply company, as a result of which the assembly effort can be reduced. In addition, an additional housing for the catalytic converter is not necessary here either, since the latter is accommodated together with the supercharger in a single housing.

In accordance with again another feature of the invention, fastening element, the bead, or the collar-like end section serves as a seal for the gastight connection with the exhaust pipe or supercharger. To be regarded here as the advantage is that it avoids an additional sealing element, which normally has to be provided when the catalytic converter is fitted into the exhaust system. The fastening element of the catalytic converter at the same time forms its sealing element.

With the above and other objects in view there is also provided, in accordance with the invention, an exhaust gas purification assembly for an internal combustion engine having an exhaust manifold, comprising:

- a supercharger for compressing combustion air on an exhaust gas turbocharger principle, the supercharger having an exhaust inlet opening communicating with an exhaust manifold of an internal combustion engine;
- a catalytic converter connected between the exhaust inlet opening of the supercharger and the exhaust manifold of the internal combustion engine.

The catalytic converter in this case assumes the function of treating exhaust gases even at a low temperature level. Directly after the clustering of the exhaust lines through an exhaust manifold, the exhaust gases are passed through the catalyst carrier body at the connecting joint to the exhaust turbocharger. The energy for compressing combustion air in the exhaust turbocharger is not taken from the exhaust gas until after this.

In this way, it is possible to improve the overall efficiency of treating exhaust gas in an engine with an exhaust turbocharger. It avoids a situation in which fractions of exhaust gas which, on account of the energy removal by the supercharger, cool too much to be treated then by the second catalytic converter, known per se, downstream of the exhaust turbocharger are able to escape untreated into the atmosphere.

In accordance with yet an added feature of the invention, the catalytic converter has a metallic catalyst carrier body and is arranged close to the exhaust inlet opening of the supercharger. To be regarded here as the main advantage of the metallic catalyst carrier body is that as large a surface structure as possible can be formed inside the catalyst carrier body, for coating with the catalyst element over as large a surface area as possible. Furthermore, this allows the catalyst carrier body to have very thin inside walls, as a result of which its flow resistance can be kept as low as possible. This is the precondition for it also being possible for the catalyst carrier body to be arranged ahead of the supercharger, without impairing the latter in its operating mode.

In accordance with a concomitant feature of the invention, the catalytic converter is adapted for being retrofitted into conventional exhaust systems with a supercharger. It is made possible in this way for the catalytic converter, which is provided between the combustion engine and the supercharger, also to be retrofitted into conventional exhaust systems, whereby the catalytic efficiency of these systems can be improved considerably. The assembly according to the invention is especially advantageous in this respect for diesel engines, in which the temperature of the exhaust gases is lower than in the case of spark-ignition engines. This is so because the diesel exhaust-gas temperature can often lie in ranges below the catalytic reaction temperature for corresponding constituents of the diesel exhaust. With the assembly according to the invention, significant pollutant reductions can consequently be achieved here in particular.

Other features which are considered as characteristic for the invention are set forth in the appended claims.

Although the invention is illustrated and described herein as embodied in a catalytic converter for emission control and emission-control assembly with a catalytic converter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
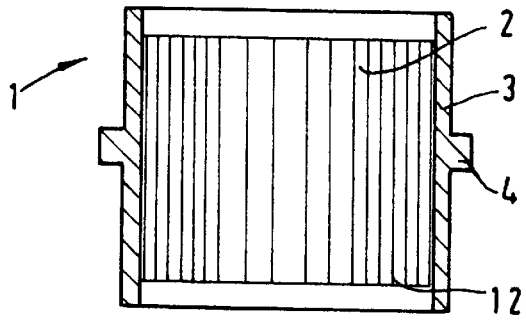
FIG. 1 is a sectional side view of a catalytic converter with a collar-like bead.
Figure 2:
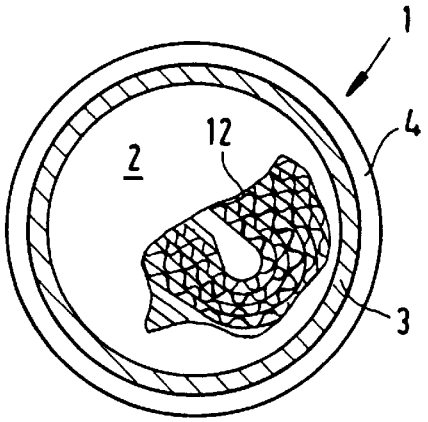
FIG. 2 shows a sectional plan view of the catalytic converter shown in FIG. 1.

Referring now to the figures of the drawing in detail and first, particularly, to FIGS. 1 and 2 thereof, there is shown a catalytic converter 1 which includes a catalyst carrier body 2 inside a cylindrical tubular jacket 3. The tubular jacket 3 is formed with a peripheral collar-like bead 4 centrally on its outer side. The bead serves as a retaining element 4 for the catalytic converter 1. In the preferred embodiment, the catalyst carrier body 2 inside the tubular jacket 3 consists of metal. The catalyst carrier body 2 is assembled with layers of sheet metal in such a way that they form a cross-sectionally wound honeycomb structure. Only certain regions of the honeycomb body with its flow channels have been represented in FIG. 2 for the purposes of illustration. The honeycomb structure of the catalyst carrier body 2 forms a number of flow channels 12 through which exhaust gas flows and in which it is treated.

Figure 3:
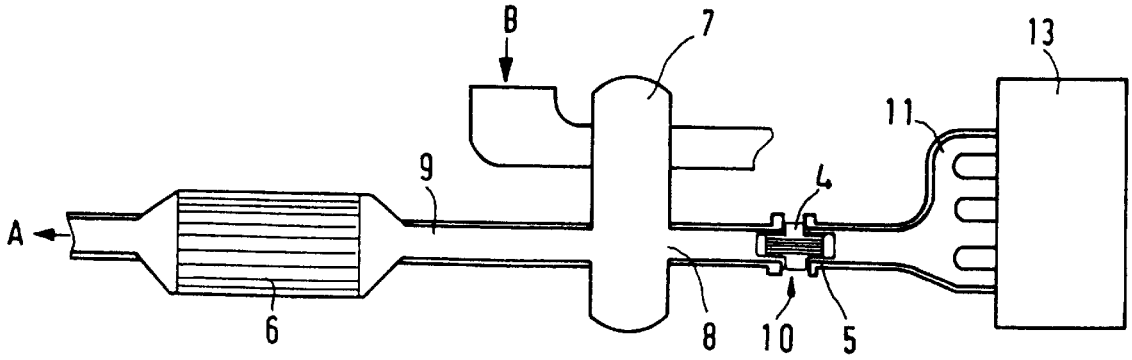
FIG. 3 is a schematic illustration of an exhaust gas purification system according to the invention with a catalytic converter equipped with a collar-like bead.

In FIG. 3, an assembly according to the invention is represented in schematic form. A catalytic converter 5 is arranged in a exhaust pipe 9 of a combustion engine 13 upstream of the exhaust turbocharger 7. The term upstream relates to the direction of flow of the exhaust gas, which is indicated in the figure with an arrow A). The catalytic converter 5 is inserted at a connecting joint 10. In this way, the catalytic converter 5 can treat exhaust gases directly after the exhaust manifold 11 of the combustion engine 13 at still high, i.e., adequately high, temperatures of the exhaust gas.

A second catalytic converter 6 is located downstream of the exhaust turbocharger 7 in the direction of flow of the exhaust gas (arrow A). The exhaust turbocharger is for its part subject to a flow of combustion air of the internal combustion engine 13 (arrow B in FIG. 3). As an alternative to the exemplary embodiment of an assembly according to the invention represented in FIG. 3, the first catalytic converter 5 may also be arranged directly at the exhaust inlet opening 8 of the supercharger 7.

Further advantages and advantageous features of the invention are contained in the following claims, in the abstract and in the drawing.

We claim:

1. In combination with an internal combustion engine having an exhaust pipe with a connecting joint and a supercharger for compressing a combustion air on the principle of an exhaust turbocharger, a catalytic converter for cleaning exhaust gas of the internal combustion engine flowing in the exhaust pipe along a given flow direction, the catalytic converter comprising:

a catalyst carrier body formed with a multiplicity of flow channels;

a tubular jacket encasing said catalyst carrier body, said tubular jacket having a first end region and a second end region opposite said first end region;

said catalyst carrier body being adapted to being fitted into the connecting joint in the exhaust pipe ahead of the supercharger in a flow direction of the exhaust gas; and a retaining element for fastening the catalyst carrier body in the connecting joint, said retaining element being a collar-type bead formed on said tubular jacket between said first end region and said second end region.

2. In combination with an internal combustion engine having an exhaust pipe with a connecting joint and a supercharger for compressing a combustion air on the principle of an exhaust turbocharger, a catalytic converter for cleaning exhaust gas of the internal combustion engine flowing in the exhaust pipe along a given flow direction, the catalytic converter comprising:

a catalyst carrier body formed with a multiplicity of flow channels;

a tubular jacket encasing said catalyst carrier body;

said catalyst carrier body being adapted to being fitted into the connecting joint in the exhaust pipe ahead of the supercharger in a flow direction of the exhaust gas such that no additional housing is required for said catalyst carrier body; and only one retaining element for fastening the catalyst carrier body in the connecting joint, said retaining element being a collar-type bead formed on said tubular jacket.

3. The catalytic converter according to claim 2, wherein said retaining element is a collar formed on an end section of said tubular jacket.

4. The catalytic converter according to claim 2, wherein said catalyst carrier body is a metallic honeycomb body formed of wound layers of sheet metal.

5. The catalytic converter according to claim 1, wherein said bead forms a seal for a gas-tight connection to one of the exhaust pipe and the supercharger.

6. The catalytic converter according to claim 2, wherein said collar forms a seal for a gas-tight connection to one of the exhaust pipe and the supercharger.

7. The catalytic converter according to claim 2, wherein said fastening element forms a seal for a gas-tight connection to one of the exhaust pipe and the supercharger.

8. The catalytic converter according to claim 2, wherein said catalyst carrier body is configured to be fitted into an exhaust inlet opening of the supercharger.

9. The catalytic converter according to claim 8, wherein said catalyst carrier body is configured to be integrated into the supercharger and to form a unit with the supercharger.

10. An exhaust gas purification assembly for an internal combustion engine having an exhaust manifold, comprising:

a supercharger for compressing combustion air on an exhaust gas turbocharger principle, said supercharger having an exhaust inlet opening communicating with an exhaust manifold of an internal combustion engine;

a catalytic converter including a catalyst carrier body formed with a multiplicity of flow channels and including a tubular jacket encasing said catalyst carrier body;

an exhaust pipe section extending between said exhaust inlet opening and the exhaust manifold, said exhaust pipe section having a connecting joint;

said catalytic converter being connected between said exhaust inlet opening of said supercharger and the exhaust manifold of the internal combustion engine, and said catalyst carrier body being adapted to being fitted into said connecting joint in said exhaust pipe section such that no additional housing is required for said catalyst carrier body; and only one retaining element for fastening said catalyst carrier body in said connecting joint, said retaining element being a collar-type bead formed on said tubular jacket.

11. The assembly according to claim 10, wherein said catalytic converter includes a metallic catalyst carrier body and is disposed in close vicinity to said exhaust inlet opening of said supercharger.

12. The assembly according to claim 10, wherein said catalytic converter is configured for retrofitting into a conventional exhaust system with a supercharger.

13. The assembly according to claim 10, wherein the combustion engine is a diesel engine.

* * * * *

UNITED STATES PATENT AND TRADEMARK OFFICE

CERTIFICATE OF CORRECTION

PATENT NO. : 6,397,588 B1
APPLICATION NO. : 09/583790
DATED : June 4, 2002
INVENTOR(S) : Rolf Brück et al.

It is certified that error appears in the above-identified patent and that said Letters Patent is hereby corrected as shown below:

Item [30] should read as follows:

Foreign Application Priority Data

Sep. 14, 1989 (DE) …….. 299 16 158.7

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,397,588 B1
APPLICATION NO. : 09/583790
DATED : June 4, 2002
INVENTOR(S) : Rolf Brück et al.

It is certified that error appears in the above-identified patent and that said Letters Patent is hereby corrected as shown below:

Item [30] should read as follows:

Foreign Application Priority Data

Sep. 14, 1999 (DE) ..... 299 16 158.7

This certificate supersedes the Certificate of Correction issued August 22, 2006.

Signed and Sealed this
Eighth Day of January, 2013

David J. Kappos

David J. Kappos
*Director of the United States Patent and Trademark Office*